United States Patent [19]

Pelfrey

[11] 4,149,325

[45] Apr. 17, 1979

[54] FIELD GOAL KICKING SHOE

[76] Inventor: Raymond H. Pelfrey, 1595 Howard Dr., Sparks, Nev. 89431

[21] Appl. No.: 868,989

[22] Filed: Jan. 12, 1978

[51] Int. Cl.[2] ..... A43B 5/02

[52] U.S. Cl. ..... 36/133; 36/128

[58] Field of Search ..... 36/133, 128, 113, 77

[56] References Cited

U.S. PATENT DOCUMENTS

| | | | |
|---|---|---|---|
| 1,221,985 | 4/1917 | Golden | 36/128 |
| 1,376,635 | 5/1921 | Pierce | 36/128 X |
| 1,726,198 | 8/1929 | Stahl | 36/128 |
| 2,107,667 | 2/1938 | Hermson | 36/128 |
| 2,503,586 | 4/1950 | Miller | 36/133 X |
| 3,350,796 | 11/1967 | Bealle | 36/133 |
| 3,406,469 | 10/1968 | Dani | 36/133 |

FOREIGN PATENT DOCUMENTS

| | | | |
|---|---|---|---|
| 2637806 | 2/1978 | Fed. Rep. of Germany | 36/133 |

*Primary Examiner*—James Kee Chi

[57] ABSTRACT

The shoe is provided with a toe portion which has a flat, ball-impacting, front wall which is forwardly slanted at a 5–15 degree angle and which has a flat, leading edge on the sole which terminates approximately flush with the bottom edge of the ball-impacting front wall.

5 Claims, 5 Drawing Figures

FIELD GOAL KICKING SHOE

SUMMARY OF THE INVENTION

The essential object and advantage of the invention is to provide a field goal kicking shoe at its forward end with a forwardly inclined, substantially planar, ball-impacting surface. I have found that such a surface provides for greater distance, increased initial lift of the ball and greater kicking accuracy.

The most pertinent prior art known to me consists of the conventional field goal kicking shoe which I have depicted in the accompanying drawing and U.S. Pat. Nos. 1,610,700, 1,689,535, 3,406,649 and 3,497,971.

The foregoing and other objects and advantages of the invention will be apparent from the following description taken in conjunction with the drawing forming part of this specification, and in which.

DESCRIPTION OF THE INVENTION

Figure 2:
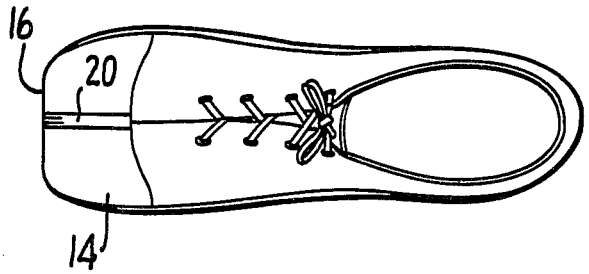
FIG. 2 is a top plan view of the shoe of FIG. 1.

The shoe comprises a cleated sole 10 having a bias-cut leading edge 12 and an upper 14 having a toe portion comprising a reinforcement toe cup 14. The toe portion is provides with a flat ball-impacting surface 16 which is forwardly inclined from the vertical to the extent of 1–15 degrees and preferably to the extent of 5–8 degrees. It is to be noted that the ends 12 and 16 of the sole and toe portion are flush with each other so as to make up a single overall ball-impacting surface.

Figure 3:
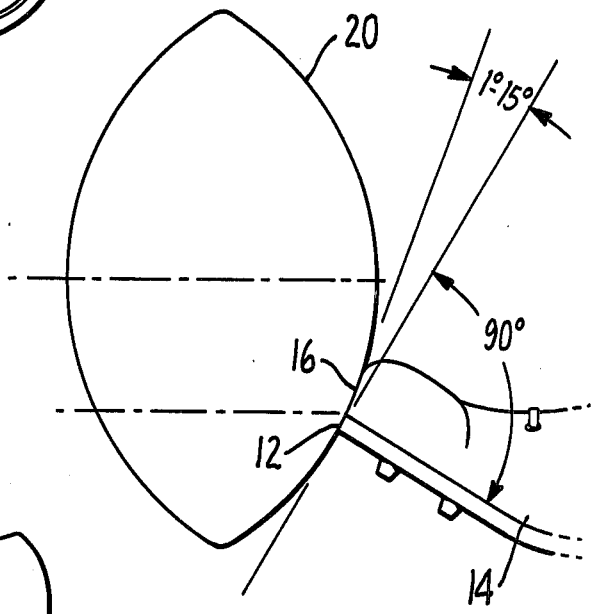
FIG. 3 is a view in side elevation of the subject shoe in kicking contact with a football positioned as it would be by an able holder.

FIG. 3 shows a football 20 properly positioned with its longitudinal axis disposed vertically for the attempted kicking of a field goal. The kicker locks his ankle to incline his kicking shoe upwardly at an angle of about 30 degrees. The optimum place for kicking contact is along the centerline of the ball at a point approximately one-quarter of the length of the ball away from its ground-positioned, lower end. With the ball and kicking shoe so positioned, the ball-impacting surface made up of surfaces 12 and 16 engage the ball as shown in FIG. 3. The unitary ball-impacting surface provides for total, instantaneous impact between shoe and ball and eliminates the secondary and tertiary impact points which are set up between shoe and ball by the usage of the conventional field goal kicking shoe. With such total, instantaneous impact between shoe and ball, both the kicking distance and the initial lift imparted to the ball are enhanced. The unitary, forwardly inclined, ball-impacting surface also provides for greater kicking accuracy.

Figure 1:
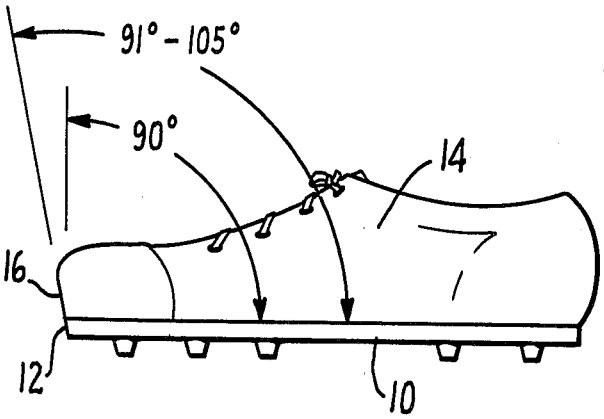
FIG. 1 is a view in side elevation of the subject shoe.
Figure 4:
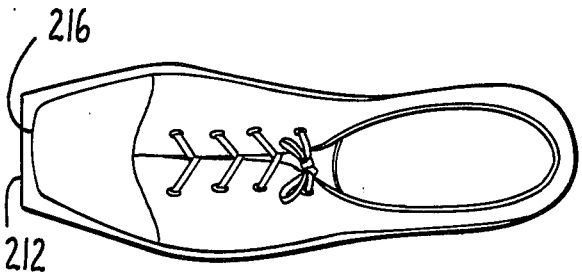
PRIOR ART FIG. 4.
FIG. 4 is a top plan view of the conventional field goal kicking shoe which is being used at the present time.
Figure 5:
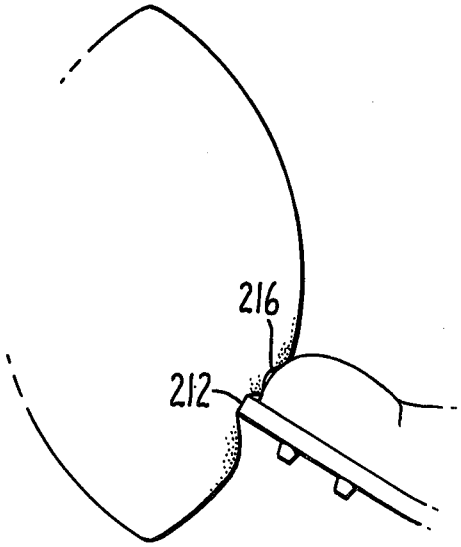
PRIOR ART FIG. 5.
FIG. 5 is a view in side elevation of the shoe of FIG. 4 in initial ball-impacting position.

A conventional field goal or placement kicking shoe is shown in FIGS. 4 and 5. The one shown is for the left foot whereas the shoe of FIGS. 1 and 2 is a right-footed kicking shoe. There is a compound or discontinuous ball-impacting surface made up of the front end 216 of the toe portion and the square-cut leading edge 212 of the sole portion, the latter being the primary impacting means and the former being the secondary impacting means. The greatest single cause of missed placement kicks with this conventional shoe is due to the impacting of the protruding sole to either the left or the right of the centerline of the football. This causes the ball to be pulled to either the left or the right resulting in a missed kick.

The subject shoe is preferably provided with a central, visual guideline 20 to visually assist the kicker in applying the mid-point of the ball-impacting surface to the centerline of the ball.

What is claimed is:

1. A football placement kicking shoe comprising toe and sole portions having aligned leading surfaces which together define an overall flat ball-impacting surface which defines with said sole portion of the shoe an obtuse included angle of from about 91° to about 105°.

2. The shoe of claim 1, said ball-impacting surface being substantially continuous and planar.

3. A football placement kicking shoe comprising a sole portion and a toe portion, said toe portion having a flat leading ball-impacting surface which defines with said sole portion of the shoe an obtuse included angle of from about 91° to about 105°.

4. The shoe of claim 3, said ball-impacting surface being substantially continuous and planar.

5. The shoe of claim 3, said angle being from about 95 to about 98 degrees.

* * * * *